US006053711A

United States Patent [19]

Johnson

[11] Patent Number: 6,053,711

[45] Date of Patent: Apr. 25, 2000

[54] PUMP FOR PRESSURIZING CONTROL SYSTEM

[75] Inventor: Clarence William Johnson, Calgary, Canada

[73] Assignee: Barber Industries Inc., Calgary, Canada

[21] Appl. No.: 08/991,240

[22] Filed: Dec. 16, 1997

[51] Int. Cl.[7] ..... F04B 23/04

[52] U.S. Cl. ..... 417/521; 417/532

[58] Field of Search ..... 417/521, 531, 417/532, 440, 442, 502, 307

[56] References Cited

U.S. PATENT DOCUMENTS

| | | | |
|---|---|---|---|
| 895,666 | 8/1908 | Nelson | 417/427 |
| 904,557 | 11/1908 | Nelson | 417/427 |
| 3,713,291 | 1/1973 | Kubik | 60/444 |
| 3,771,912 | 11/1973 | Conlee | 417/397 |
| 4,596,375 | 6/1986 | Hurta et al. | 251/24 |

OTHER PUBLICATIONS

"Baker CAC" brochure. 3 page brochure. 1989–1990.

ENERPAC "High Force Hydraulic Tools" brochure. 3 page brochure. 1994.

"Power Team" brochure. 3 page brochure. 1997.

*Primary Examiner*—Charles G. Freay

*Assistant Examiner*—David J. Torrente

*Attorney, Agent, or Firm*—John Russell Uren

[57] ABSTRACT

Pump to supply fluid to at least two circuits in a control system for a production well. Each of the circuits is maintained at different pressures. The pump provides fluid to a plurality of poppets that are opened or closed depending on the positions of a cam surface which controls the position of the poppet. A pressure relief valve is used to prohibit fluid from entering a circuit unless the pressure exceeds the pressure of the fluid in the control circuit. The cam surfaces are controlled by a knob rotatable by an operator. By rotating the knob, the poppets can be opened or closed so as to provide fluid sequentially to each of the circuits and pressurize each circuit individually.

17 Claims, 6 Drawing Sheets

PUMP FOR PRESSURIZING CONTROL SYSTEM

INTRODUCTION

This invention relates to a pump and, more particularly, to a pump used to produce a plurality of pressures for use in a safety control system for oil production.

BACKGROUND OF THE INVENTION

Separate pumps to produce different pressures in different circuits are known. Likewise, pumps are known which provide two pressures for two hydraulic circuits. Such pumps, however, may require separate controls to pressurize each circuit. Accordingly, such controls may be confusing to operate particularly if the operator is unskilled.

In a control system for opening and closing a downhole surface controlled subsurface safety valve (SCSSV) and a surface safety valve (SSV), there are three fluid pressures. First, there is control pressure used for the fluid in the control system used in the shutdown of the surface controlled subsurface safety valve after the closure of the surface safety valve. The control circuit pressure is at the low end of the pressure range relative to the pressures in the remaining circuits, typically being up to approximately 150 psi. Second, there is fluid pressure used to maintain the surface controlled subsurface safety valve in its open configuration under operating conditions. This fluid is maintained at the high end of the pressure range, typically being between 5000–10000 psi. Third, there is the fluid pressure used to maintain the surface safety valve in its open condition. The fluid in this circuit is typically within a pressure range of 1000–3500 psi.

The higher the fluid pressure required, the smaller the piston of the pump that is used to pressurize the circuit. Therefore, different pistons have typically been used to supply the necessary fluid to the different circuits. A larger piston may be used to supply control pressure fluid and to supply fluid to the surface safety valve circuit. A smaller piston may be used for supplying fluid to the circuit of the surface controlled subsurface safety valve.

SUMMARY OF THE INVENTION

According to one aspect of the invention, there is provided a pump to provide fluid to at least one hydraulic circuit having a pressure maintained at a predetermined value, said pump comprising a piston movable in a cylinder, a first chamber below said piston within said cylinder, a first inlet passageway to said first chamber to supply hydraulic fluid to said first chamber, a first exit passageway from said first chamber to supply fluid to said one circuit, a second exit passageway extending to a first poppet, said first poppet being movable between open and closed positions by a first cam surface acting on said first poppet, said first cam surface being connected to a control and being movable by said control.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
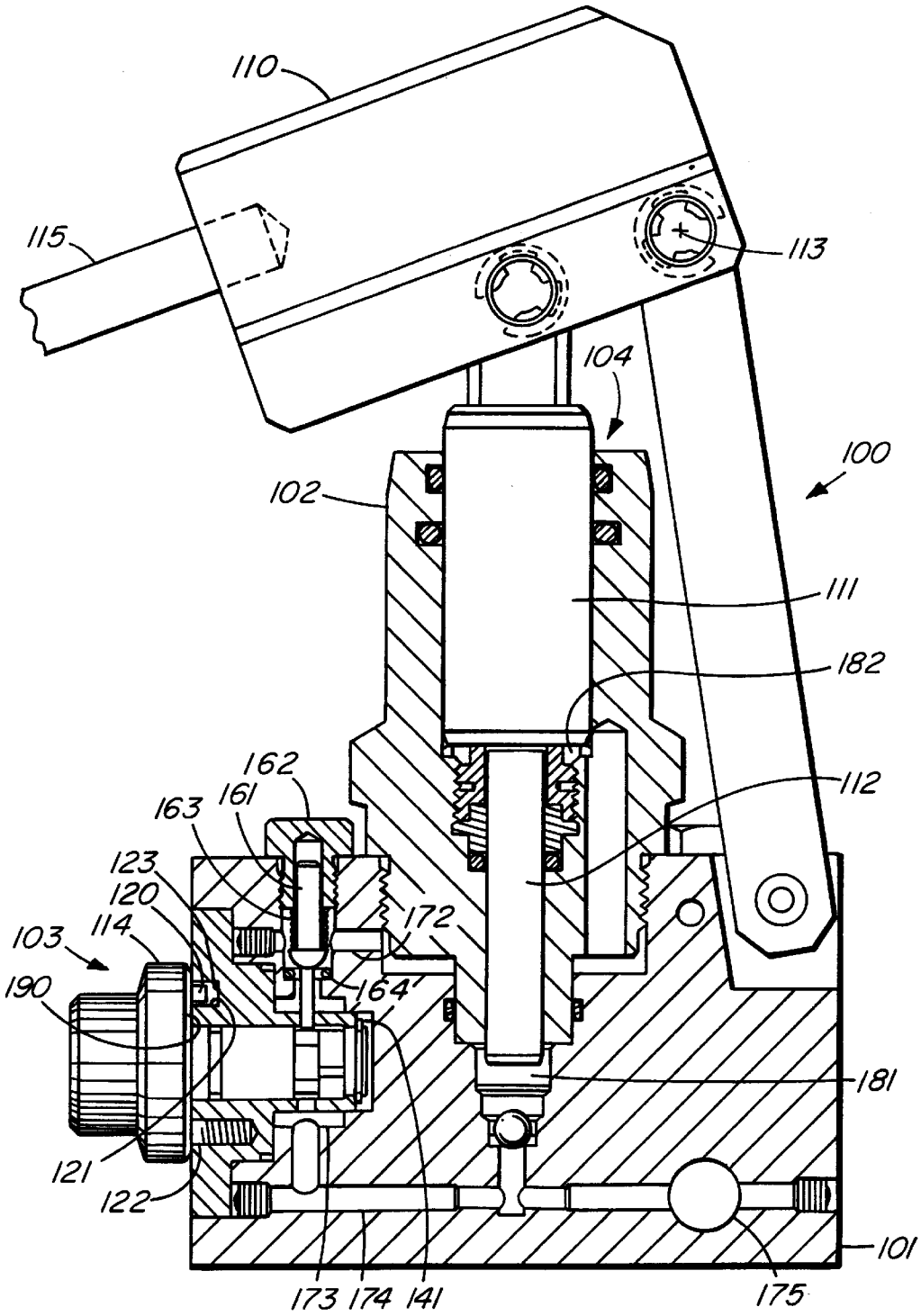
FIG. 1 is a diagrammatic side partial cross-sectional view of the pump according to the invention.

Referring now to the drawings, a three pressure output pump according to the invention is illustrated generally at 100 in FIG. 1. The three output pump 100 comprises a base 101, a barrel 102, a selector cam assembly generally illustrated at 103, a plunger generally illustrated at 104, a lever 110 used to reciprocate plunger 104 and a handle 115 connected to lever 110.

Plunger 104 comprises a low pressure plunger 111 and a high pressure plunger 112. The low and high pressure plungers 111, 112 are connected and operate simultaneously when lever 110 is rotated about pin 113 by the use of a pump handle 115 which is connected to the lever 110.

Figure 4:
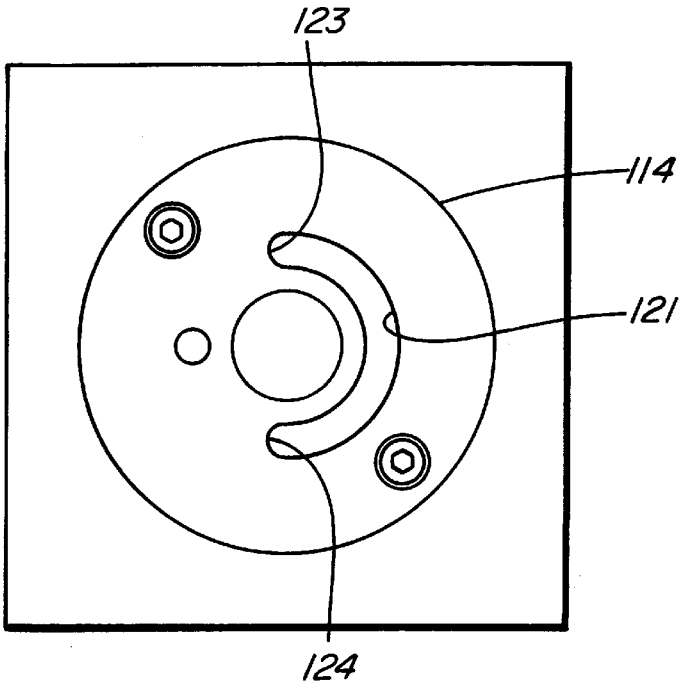
FIG. 4 is a back view illustrating the selector cam assembly used to determine the circuit to which fluid is being pumped.

The selector cam assembly 103 comprises a rotatable knob 114 with a pin 120 connected thereto which moves within a groove 121 (FIGS. 1 and 4). A ball detent 122 is provided which maintains the knob 114 in position midway between the end points 123, 124 (FIG. 4) defined by the ends of groove 121 as will be explained.

Figure 5:
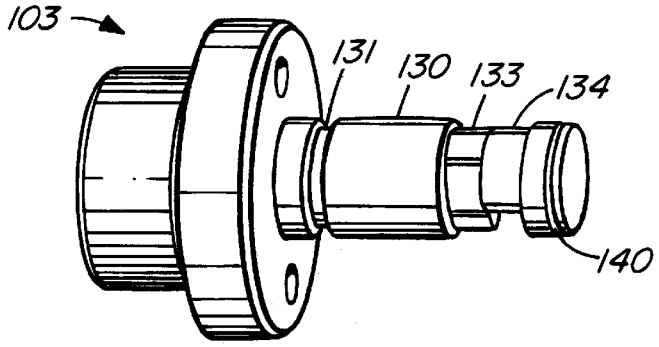
FIG. 5 is an isometric view of the selector cam assembly according to the invention.

Selector cam assembly 103 further comprises a barrel 130 (FIG. 5). Barrel 130 includes a recess 131 for an o-ring 132, two cam surfaces 133, 134 (also shown in FIGS. 6B and 6C) and a groove 140 used to hold a retaining ring 141 (FIG. 1) which maintains the selector cam assembly 103 in its axial or longitudinal position within the base 101 of the pump 100.

Figure 6A:
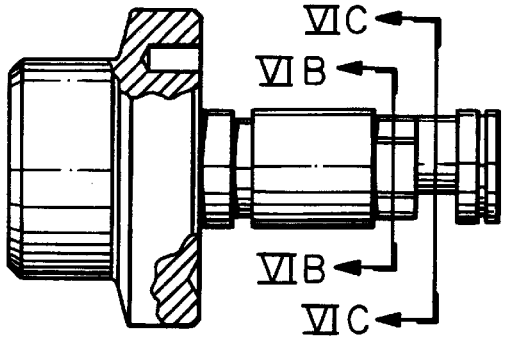
FIG. 6A is a side partial sectional view of the selector cam assembly of FIG. 5.
Figure 6B:
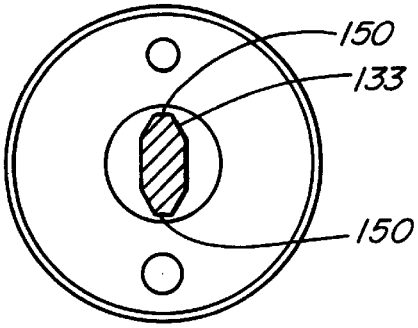
FIG. 6B is a sectional view taken along VIB—VIB of FIG. 6A.
Figure 6C:
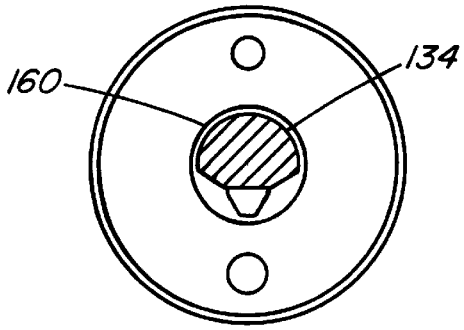
FIG. 6C is a sectional view taken along VIC—VIC of FIG. 6A.

The cam surface 133 is generally longitudinal in shape as seen in FIG. 6B. The cam surface 134 has a generally circular one half as seen in FIG. 6C. Each of the cam surfaces 133, 134 are intended to contact followers or poppets as will be described.

Cam surface 133 has a corresponding follower (FIG. 3) in the form of a poppet 142 (FIG. 3) and a second follower in the form of poppet 161 (FIG. 1). A plug 143 is mounted in base 101 and poppet 142 is mounted for reciprocal movement therein with a compression spring 144 mounted between the poppet 142 and the plug 143 to maintain a bias outwardly from the plug 143 on the poppet 142 so that the poppet 142 will be in contact with cam surface 133 when the lobes 150 (FIG. 6B) are beneath the poppet 142. An o-ring 151 is mounted in the base 101 to provide a seal to fluid passage when the poppet 142 is in contact with the o-ring 151 when the lobes 150 are not beneath the poppet 142 and the poppet 141 is closed under the influence of compression spring 144.

A second poppet 152 is mounted in a second plug 153 which is mounted in base 101. A compression spring 154 acts between the plug 153 and the poppet 152 is maintain the poppet 152 in contact with cam surface 134 when the lobe 160 (FIG. 6C) is beneath the poppet 152. An o-ring 155 is mounted within plug 153 and seals the passage to fluid flow when poppet 152 is in contact with o-ring 155.

A third poppet 161 is mounted in a third plug 162 (FIG. 1) and a compression spring 163 is likewise mounted between the plug 162 and the poppet 161 in order to maintain a bias on the poppet 161 so as to maintain contact with the lobe 150 of cam surface 133. An o-ring 164 is mounted within plug 162 and seals the passage to fluid flow when poppet 161 is in contact with o-ring 164.

Figure 3:
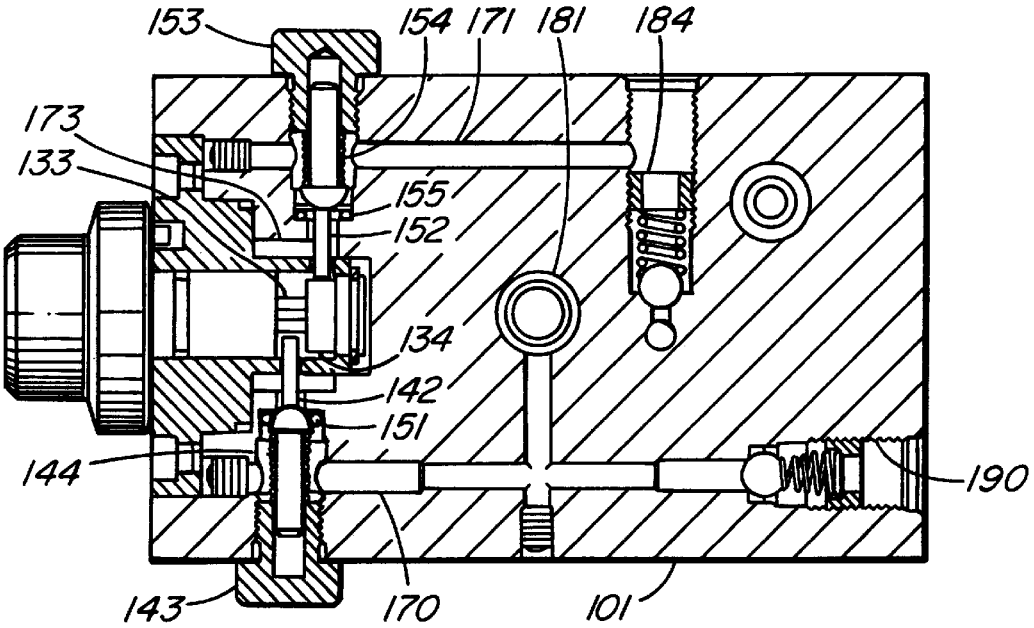
FIG. 3 is a bottom partial sectional view of the pump of FIG. 1.

Each of the poppets 142, 152, 161 is associated with an entrance fluid flow passageway 170, 171, 172, respectively, as seen in FIGS. 1 and 3. A circumferential recess 173 extends around the circumference of the selector cam assembly 103 and downstream of each of the poppets 142, 152, 161. The recess 173 receives fluid from the poppets 142, 152, 161 when the poppets 142, 152, 161 are in the open condition and not in contact with their respective o-rings 151, 155, 164. Recess 173 returns the fluid received by the poppets 142, 152, 161 to the reservoir by way of a downstream fluid flow passageway 174 extending from the circumferential recess 173. The downstream fluid flow passageway 174 extends to the suction or reservoir port 175 (FIGS. 1 and 7).

Figure 2:
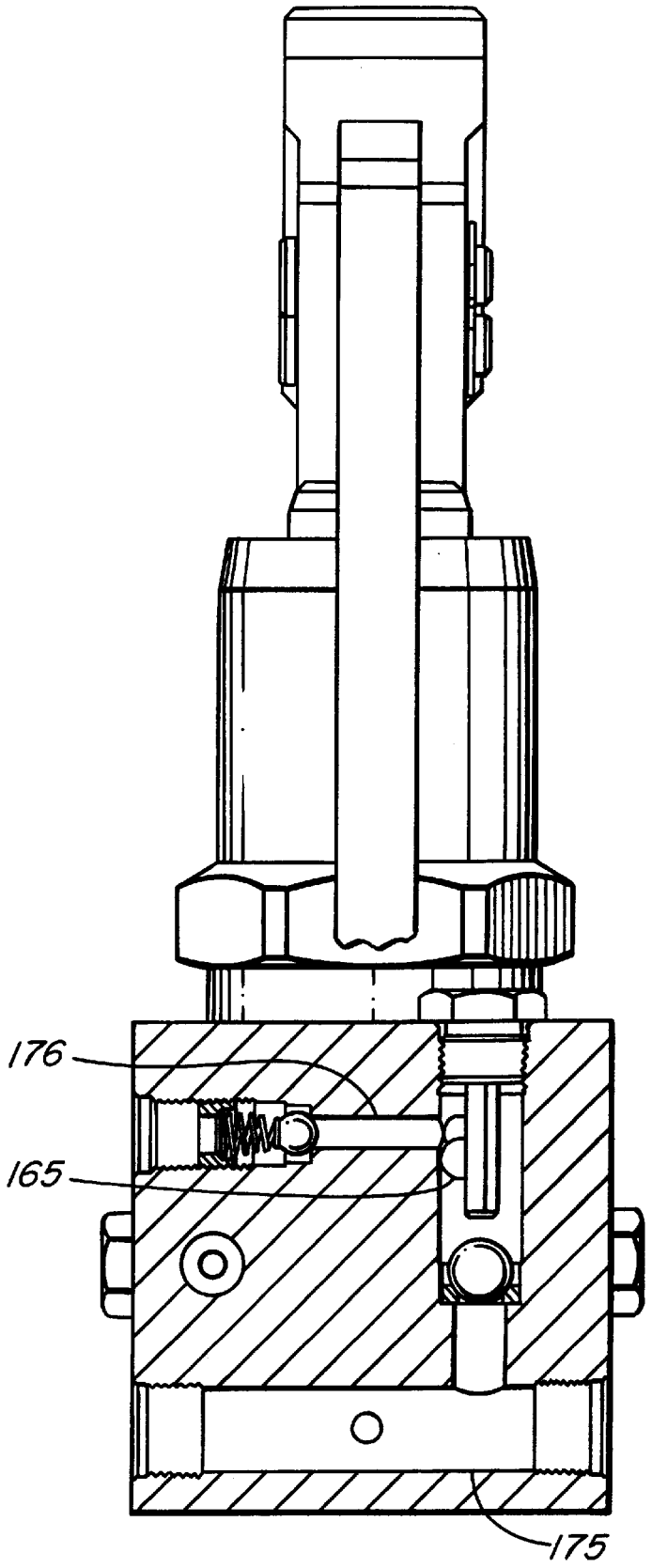
FIG. 2 is a front end partial sectional view of the pump of FIG. 1.

An inlet port 165 (FIG. 2) communicates with low pressure chamber 182 (FIG. 1). Passageway 176 communicates with control port 180.

OPERATION

Figure 7A:
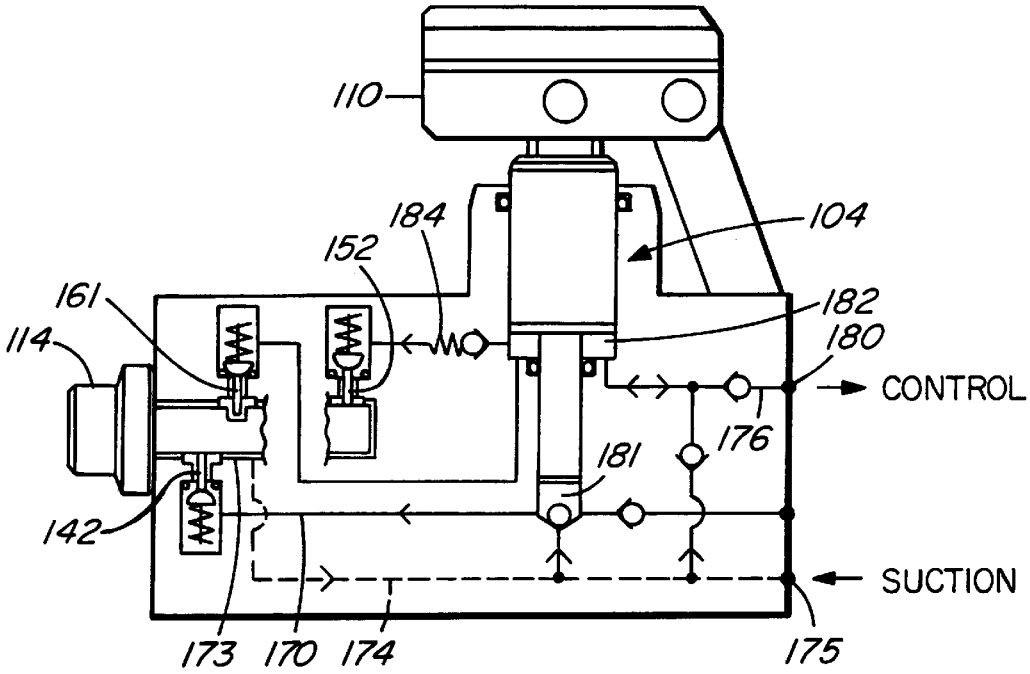
FIGS. 7A, 7B and 7C are diagrammatic side views of the pump assembly according to the invention with different operating configurations for the three circuits being pressurized.

In operation, three different circuits will be pressurized with the pump according to the invention as best described with reference to FIGS. 7A, 7B and 7C. Initially, the control pressure will be established by pumping fluid into the control circuit from port 180 as seen in FIG. 7A.

The operator will rotate knob 114 and pin 120 will move within groove 121 until it reaches its endmost position 123 (FIG. 4). Barrel 130 (FIG. 5) will rotate with knob 114 together with cam surfaces 133, 134 until position 123 is reached. In that position, poppets 142, 152 are open and poppet 161 is closed. Pumping then commences by operating lever 110. Hydraulic fluid is brought in on the suction stroke from port 175 and such fluid fills the high pressure chamber 181 and the low pressure chamber 182. The pressure stroke of plunger 104 will force the hydraulic fluid from the chambers 181, 182. Fluid from high pressure chamber 181 will travel through fluid passageway 170 to poppet 142. Poppet 142 is open so the hydraulic fluid will pass through poppet 142 to recess 173 and thence to tank through port 175 via fluid passageway 174.

Fluid from the low pressure chamber 182 will be prevented from travelling through poppet 161 because it is in the closed position. Pressure relief valve 184 will allow fluid to pass only if the pressure exceeds the desired pressure in the control circuit, conveniently 150 psi. Thus, the fluid will travel to the control circuit from control port 180. When the pressure reaches 150 psi, excess fluid travels through pressure relief valve 184 but since poppet 152 is open, the fluid will simply return to the tank through passageway 174 from recess 173. Thus, the control circuit will be fully charged.

Figure 7B:
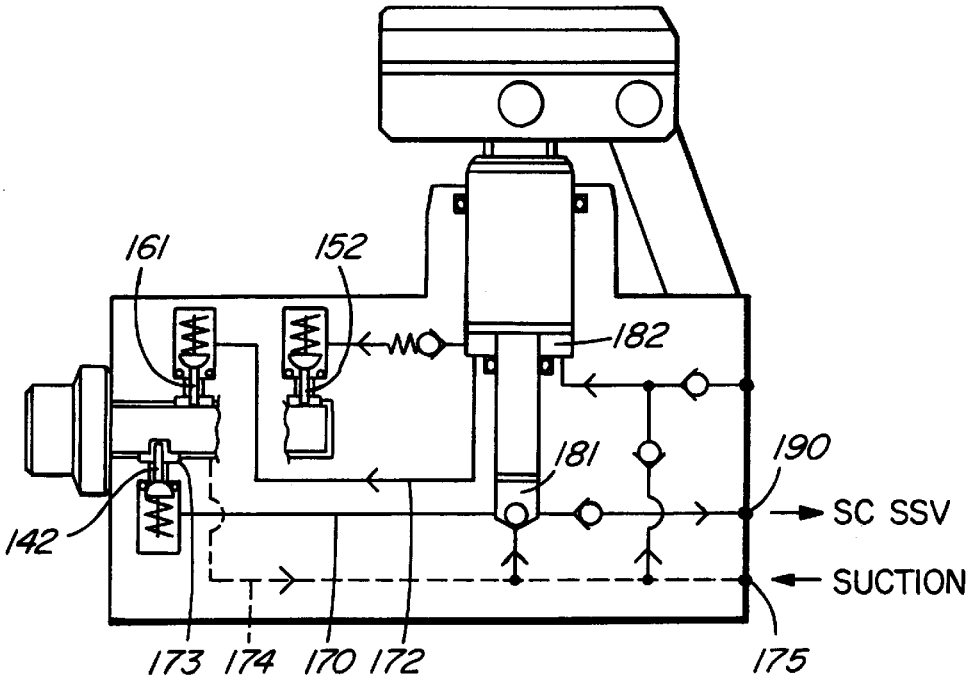

Next, the surface controlled subsurface safety valve (SCSSV) is required to be opened and, to do so, high pressure must be provided from port 190 to the SCSSV (FIG. 7B). With reference to FIG. 4, knob 114 is rotated to the middle position at which point the ball detente 122 will enter the corresponding recess in the inner surface 190 of knob 114. The cam surface 133 will hold poppet 161 open and allow poppet 142 to close. Poppet 152 will be held open by cam surface 134.

Pumping again commences. Fluid from the low pressure chamber 182 proceeds through passageway 172 to poppet 161 and, since poppet 161 is open, the fluid travels to the tank via circumferential recess 173 and passageway 174. Fluid from the low pressure chamber 181 is prevented from travelling through poppet 142 because it is closed. Accordingly, fluid will proceed to the SCSSV via port 190.

It is now required to open the surface safety valve (SSV) and to do so, the knob 114 (FIG. 4) will be rotated until the pin 120 reaches the end point 124 of groove 121. In this position, the poppets 152, 161 will both be closed and poppet 142 will be held open by cam surface 133.

Figure 7C:
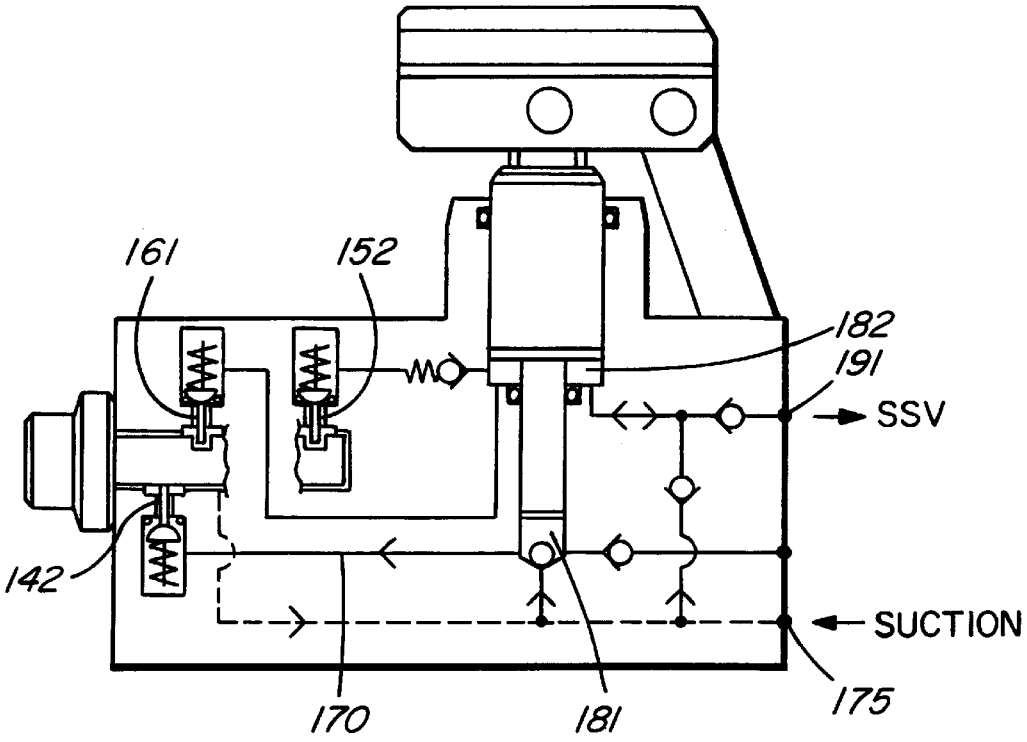

Pumping again commences and, with reference to FIG. 7C, fluid pumped from the high pressure chamber 181 will travel via passageway 170 and through poppet 142 which is in an open configuration to circumferential recess 173 and out port 175 to the reservoir or tank. Fluid from the high pressure chamber 182 can only pass out port 191 to thereby open the SSV since both poppets 152, 161 are maintained in the closed position and prevent fluid from passing therethrough.

While a specific embodiment of the invention has been described, such description should be taken by way of example only and not as limiting the scope of the invention as defined in accordance with the accompanying claims.

I claim:

1. Pump to provide fluid to at least one hydraulic circuit having a pressure maintained at a predetermined value, said pump comprising a piston movable in a cylinder, a first chamber below said piston within said cylinder, a first inlet passageway to said first chamber to supply hydraulic fluid to said first chamber, a first exit passageway from said first chamber to supply fluid to said one circuit, a second exit passageway extending to a first poppet, said first poppet being movable between open and closed positions by a first cam surface acting on said first poppet, said first cam surface being connected to a control and being movable by said control.

2. Pump to provide fluid as in claim 1 and further comprising a third exit passageway from said first chamber to a second poppet, said second poppet being movable between open and closed positions by a second cam surface acting on said second poppet, said second cam surface being connected to said control and being movable by said control.

3. Pump to provide fluid as in claim 1 and further comprising a pressure relief valve in said first exit passageway.

4. Pump to provide fluid as in claim 3 and further comprising a second piston movable within a second cylinder and a second chamber below said second piston, a second entrance passageway to supply fluid to said second chamber, a first exit passageway from said second chamber to supply fluid to a second hydraulic circuit, said pressure of said second circuit being different from said pressure of said first circuit, a second exit passageway from said second chamber extending to a third poppet, said third poppet being movable between open and closed positions by said first cam surface.

5. Pump as in claim 4 and further comprising a reservoir passageway located downstream of each of said first, second and third poppets.

6. Pump as in claim 5 wherein said first chamber is operable to contain hydraulic fluid at a relatively low pressure.

7. Pump as in claim 6 wherein said second chamber is operable to contain hydraulic fluid at a relatively high pressure.

8. Pump as in claim 7 wherein said pressure relief valve allows fluid of a pressure greater than said fluid pressure of said first circuit to pass to said first poppet and exit to said downstream passageway.

9. Pump as in claim 8 wherein said first and said third poppets are operable to be in said open positions and said second poppet is operable to be in said closed position when said fluid is pumped to said first circuit.

10. Pump as in claim 9 and further comprising a second circuit, said first and second poppets being in said closed configuration and said third poppet being in said open configuration when said fluid is pumped to said second circuit from said first chamber.

11. Pump as in claim 10 and further comprising a third circuit, said first and second poppets being in said open configuration and said third poppet being in said closed configuration when said fluid is pumped to said third circuit from said second chamber.

12. Pump to provide fluid to a plurality of hydraulic circuits, each of said circuits being maintained at different hydraulic pressures, said pump comprising a first and a second plunger, a first chamber associated with said first plunger and a second chamber associated with said second plunger, an inlet port supplying fluid to each of said first and second chambers, a first outlet port supplying fluid to a first one of said plurality of said circuits, a second outlet port supplying fluid to a second one of said plurality of said circuits and one of said first and second outlet ports supplying fluid to a third one of said plurality of said circuits.

13. Pump as in claim 12 and further comprising a first fluid passageway associated with said first chamber extending to a first poppet, said fist poppet being movable between open and closed positions by a first cam surface acting on said first poppet.

14. Pump as in claim 13 and further comprising a second fluid passageway associated with said first chamber extending to a second poppet, said second poppet being movable between open and closed positions by a second cam surface acting on said second poppet.

15. Pump as in claim 14 and further comprising a third fluid passageway associated with said second chamber extending to a third poppet, said third poppet being movable between open and closed positions by said first cam surface acting on said third poppet.

16. Pump as in claim 15 and further comprising a pressure relief valve associated with said first passageway, said pressure relief valve being operable to pass fluid having a pressure which exceeds the predetermined pressure of said fluid in said first hydraulic circuit.

17. Pump as in claim 16 and further comprising a fluid passageway downstream of said first, second and third poppets, said fluid passageway being operable to carry fluid passing any of said first, second and third poppets to a fluid reservoir.

* * * * *